US010393134B2

(12) United States Patent
Carter et al.

(10) Patent No.: US 10,393,134 B2
(45) Date of Patent: Aug. 27, 2019

(54) POLYMERIC COMPRESSOR WHEEL WITH METAL SLEEVE

(71) Applicant: BorgWarner Inc., Auburn Hills, MI (US)

(72) Inventors: Jeffrey Carter, Mirfield (GB); John Allport, Halifax (GB)

(73) Assignee: BorgWarner Inc., Auburn Hills, MI (US)

( * ) Notice: Subject to any disclaimer, the term of this patent is extended or adjusted under 35 U.S.C. 154(b) by 163 days.

(21) Appl. No.: 15/668,828

(22) Filed: Aug. 4, 2017

(65) Prior Publication Data

US 2019/0040870 A1 Feb. 7, 2019

(51) Int. Cl.

| | |
|---|---|
| ***F04D 29/00*** | (2006.01) |
| ***F04D 29/28*** | (2006.01) |
| ***F04D 29/02*** | (2006.01) |
| ***F04D 29/30*** | (2006.01) |
| *F04D 29/26* | (2006.01) |

(52) U.S. Cl.

CPC ..... *F04D 29/284* (2013.01); *F04D 29/023* (2013.01); *F04D 29/30* (2013.01); *F04D 29/266* (2013.01); *F05B 2220/40* (2013.01); *F05B 2240/30* (2013.01); *F05B 2250/60* (2013.01); *F05B 2280/10* (2013.01);

(Continued)

(58) Field of Classification Search

CPC .... F04D 29/284; F04D 29/266; F04D 29/023; F04D 29/30; F05D 2300/436; F05D 2300/603; F05D 2300/434; F05D 2300/433; F05B 2280/4003; F05B 2280/4006; F05B 2280/4008; F05B 2280/6003; F05B 2250/60; F05B 2240/30; F05B 2280/4009; F05B 2280/2001; F05B 2280/2006; F05B 2220/40; F05B 2280/10

See application file for complete search history.

(56) References Cited

U.S. PATENT DOCUMENTS 3,424,434 A 1/1969 Palfreyman
4,778,345 A * 10/1988 Ito ..... C04B 37/021 148/516

(Continued)

FOREIGN PATENT DOCUMENTS

| | | | |
|---|---|---|---|
| CN | 102418701 | A | 4/2012 |
| EP | 0 737 814 | A1 | 10/1996 |
| EP | 1 627 726 | A1 | 2/2006 |

*Primary Examiner* — Thomas N Moulis

(74) *Attorney, Agent, or Firm* — Young Basile Hanlon & MacFarlane, P.C.

(57) ABSTRACT

A compressor wheel that can be employed in devices such as turbochargers. The compressor wheel includes an axially extending hub having an inlet end, a shaft bore extending from the inlet end and an arcuate outer surface opposed to the shaft bore. The axially extending hub is composed of a metal and has a porous region located proximate to the arcuate outer surface of the axially extending hub. The compressor wheel also includes a blade array disposed on the arcuate outer surface of the axially extending hub. The blade array has an outer surface and an inner region. The blade array comprises a plurality of circumferentially-spaced, radially and axially extending blades disposed thereon and is composed, at least in part of a polymeric material. Polymeric material located in the inner region of the blade array extends into the porous region defined in the axially extending hub.

20 Claims, 4 Drawing Sheets

(52) U.S. Cl.
CPC ..... *F05B 2280/2001* (2013.01); *F05B 2280/2006* (2013.01); *F05B 2280/4003* (2013.01); *F05B 2280/4006* (2013.01); *F05B 2280/4008* (2013.01); *F05B 2280/4009* (2013.01); *F05B 2280/6003* (2013.01); *F05D 2300/433* (2013.01); *F05D 2300/434* (2013.01); *F05D 2300/436* (2013.01); *F05D 2300/603* (2013.01)

(56) References Cited

U.S. PATENT DOCUMENTS

| | | | | |
|---|---|---|---|---|
| 4,878,812 | A * | 11/1989 | Kito | F01D 5/284 416/241 B |
| 5,632,601 | A | 5/1997 | Bodmer et al. | |
| 6,976,828 | B2 | 12/2005 | Godichon et al. | |
| 8,794,914 | B2 | 8/2014 | Hommes et al. | |
| 2006/0222503 | A1 | 10/2006 | Fledersbacher et al. | |
| 2009/0050675 | A1* | 2/2009 | Baur | B23K 20/129 228/114.5 |
| 2009/0162676 | A1 | 6/2009 | El-Hibri et al. | |
| 2011/0229325 | A1* | 9/2011 | Czerwinski | F01D 5/025 416/171 |
| 2011/0250377 | A1 | 10/2011 | Qin et al. | |
| 2012/0124994 | A1 | 5/2012 | Hommes et al. | |
| 2013/0039769 | A1 | 2/2013 | Giannozzi et al. | |
| 2014/0277517 | A1 | 9/2014 | Winslow | |
| 2015/0176416 | A1* | 6/2015 | Burghardt | F01D 5/3061 428/448 |
| 2016/0312787 | A1* | 10/2016 | Sato | B22D 11/00 |

* cited by examiner

POLYMERIC COMPRESSOR WHEEL WITH METAL SLEEVE

TECHNICAL FIELD

This disclosure relates to compressor wheels. More particularly, this disclosure pertains to compressor wheels that are composed in part of polymeric materials.

BACKGROUND

Compressors are used in applications such as turbochargers, superchargers and the like. Such devices typically include a compressor wheel that includes an array of aerodynamically contoured impeller blades that are supported on a central section. The central section, such as a hub section, is mounted on a rotatable drive. In the case of a turbocharger, the rotatable shaft is driven by the turbine wheel. For turbochargers, the hub section generally includes a central axial bore into which the shaft extends and is fastened to the hub. Fastening can take any suitable form, such as the use of a threaded shaft and hub, a keyed hub or, alternately, a nose of the shaft may extend through the hub and be fastened thereto using a nut to tighten the hub against a shoulder or other diametrically enlarged structure rotatable with the shaft. The shaft rotatably drives the centrifugal compressor wheel in a direction such that the contoured blades draw in air axially and discharge that air radially outwardly at an elevated pressure level into a chamber of a compressor housing. The pressurized air is, then, supplied from the chamber to the air intake manifold of an internal combustion engine for admixture and combustion with fuel, all in a well-known manner.

Improvements in compressor technology have resulted in a variety of benefits including, but not limited to, increased compressor efficiencies, flow ranges and rapid transient response by careful design of the compressors, particularly the centrifugal compressor wheels. In order to provide increased performance, the use of polymeric centrifugal compressor wheels have been proposed. In certain applications and configurations, it is believed that polymeric compressor wheels can provide high strength and low rotational inertia components. In certain applications, polymeric compressor wheels can be more readily configured into desired vane and fin shape associated with the blades.

Polymeric compounds exhibit creep at compressor operating temperatures that can compromise their operational efficiency. It is desirable to provide a compressor wheel configuration that can provide the efficiencies of polymeric structures without issues of creep and distortion.

SUMMARY

Disclosed herein are implementations of a compressor wheel that can be employed in devices such as turbochargers. The compressor wheel includes an axially extending hub having an inlet end, a shaft bore extending from the inlet end and an arcuate outer surface opposed to the shaft bore. The axially extending hub is composed of a metal and has a porous region located proximate to the arcuate outer surface of the axially extending hub. The compressor wheel also includes a blade array disposed on the arcuate outer surface of the axially extending hub. The blade array has an outer surface and an inner region. The blade array comprises a plurality of circumferentially-spaced, radially and axially extending blades disposed thereon and is composed, at least in part of a polymeric material. Polymeric material located in the inner region of the blade array extends into the porous region defined in the axially extending hub.

Also disclosed is a turbocharger that includes the compressor wheel described herein.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Disclosed is a compressor wheel that is configured to be used in devices such as turbochargers, superchargers and the like as well as a turbocharger, supercharger or the like that incorporates the compressor wheel as described herein. In certain embodiments, the compressor wheel as disclosed herein can provide a sturdy light weight mechanism.

Figure 1:
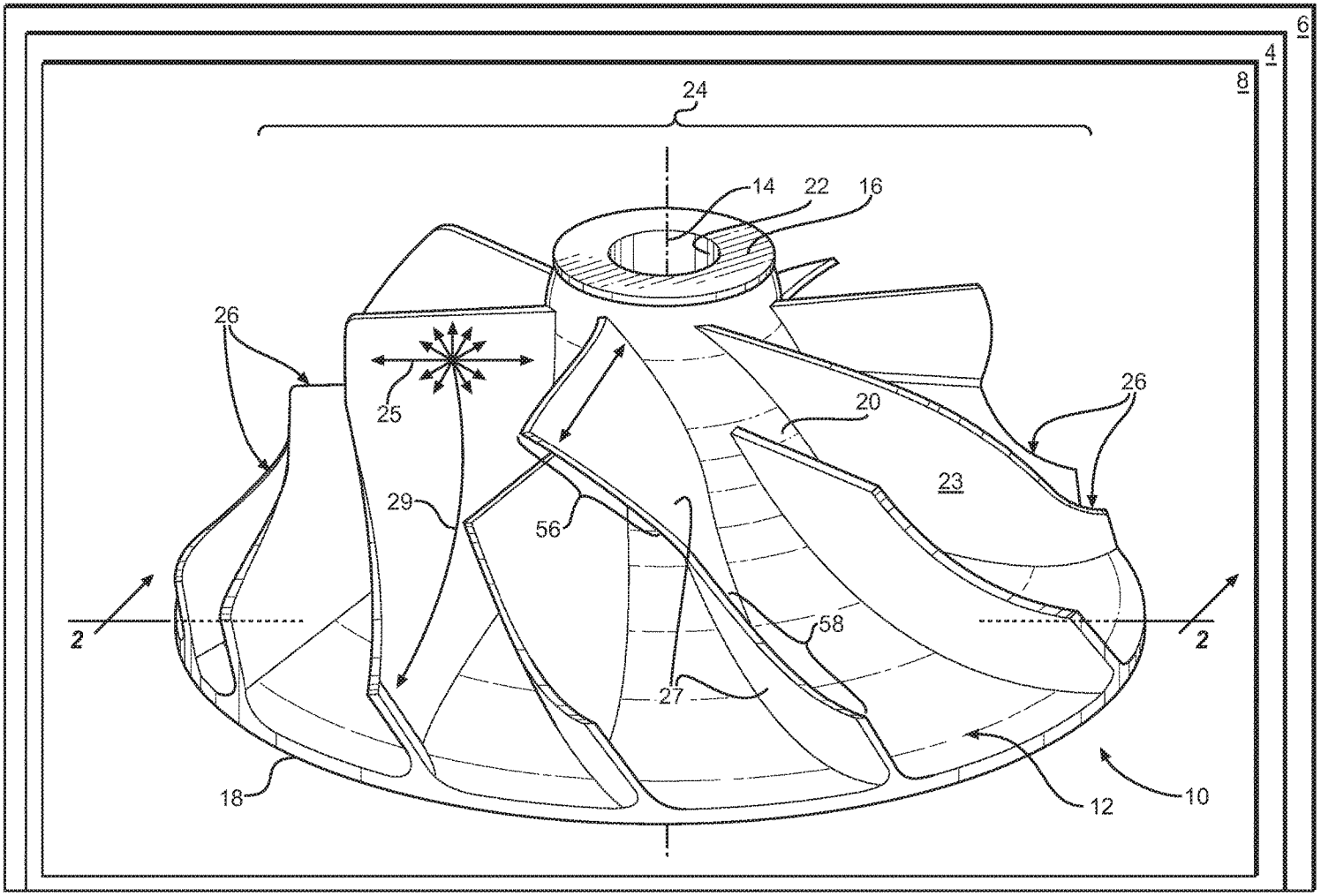
FIG. 1 is schematic perspective view of an embodiment of a compressor wheel as disclosed herein.
Figure 2:
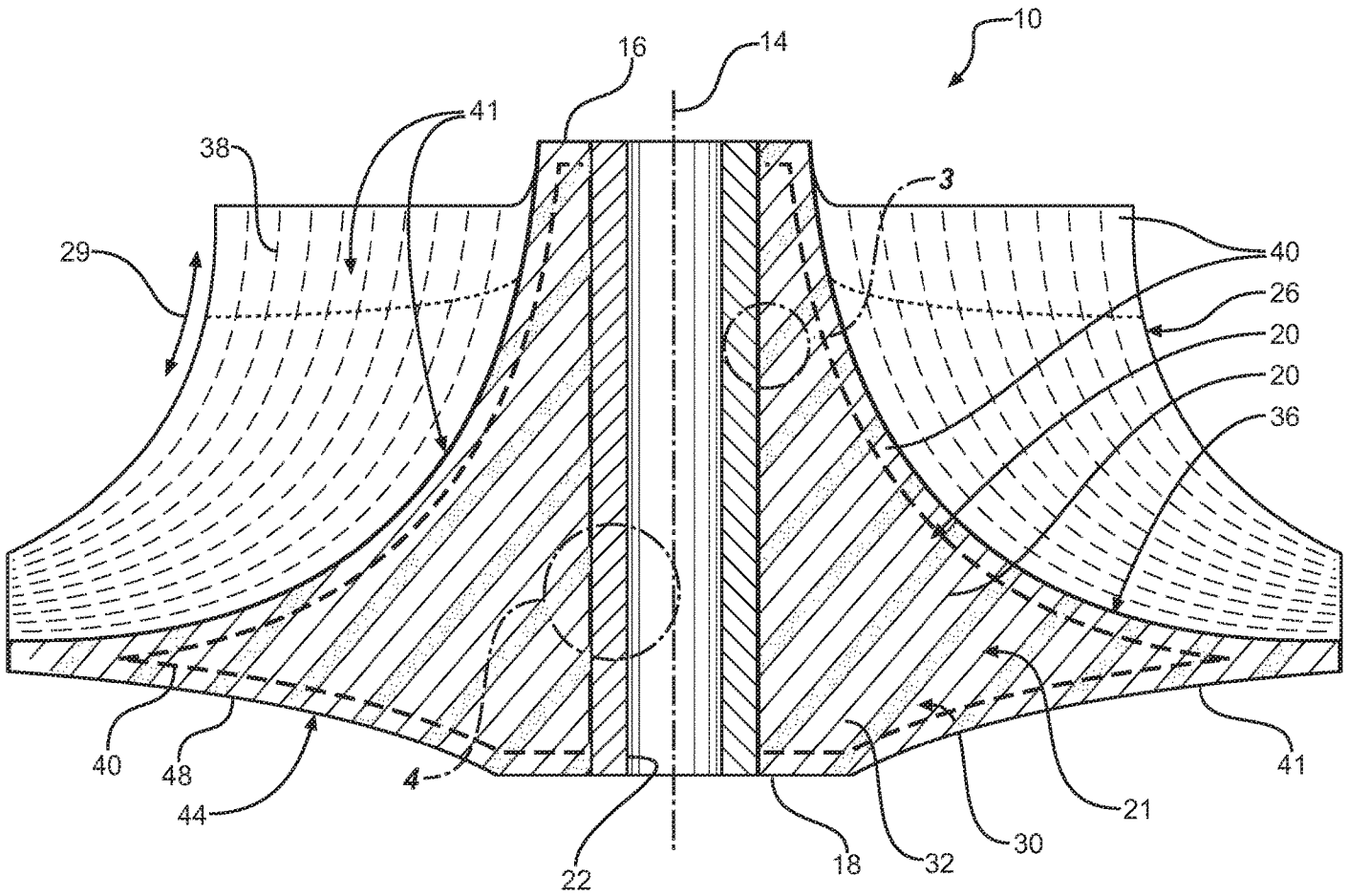
FIG. 2 is a cross sectional view of the compressor wheel as disclosed herein taken along the 2-2 line of FIG. 1.

As depicted in FIGS. 1 and 2, a centrifugal compressor wheel 10 is disclosed herein. The centrifugal compressor wheel 10 can be employed as a centrifugal impeller in a rotatable compressor 8 in many applications. These applications can include rotatable compressors 8 for various exhaust-driven turbochargers 4 or the like in conjunction with various end-use applications such as for internal combustion engines 6. The centrifugal compressor wheel 10 includes a hub 12 that extends along a longitudinal axis 14. In certain embodiments, the hub 12 of the centrifugal compressor wheel 10 can extend axially along the longitudinal axis 14.

Figure 5:
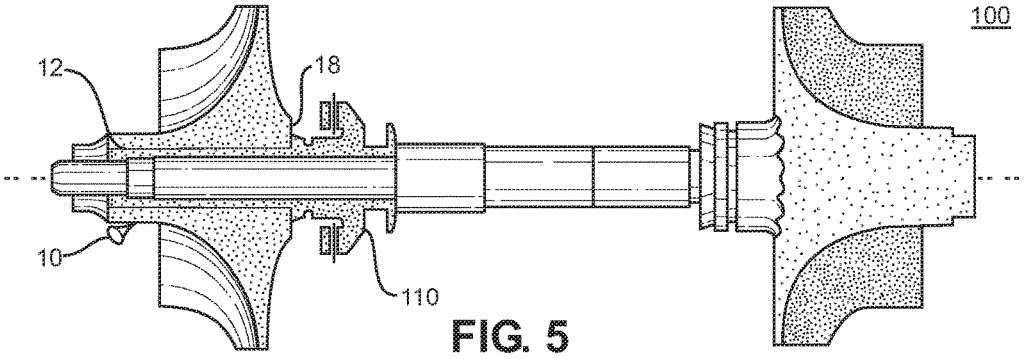
FIG. 5 is a partial cross-sectional view of an embodiment of a compressor wheel as disclosed herein mounted to a drive shaft.
Figure 6A:
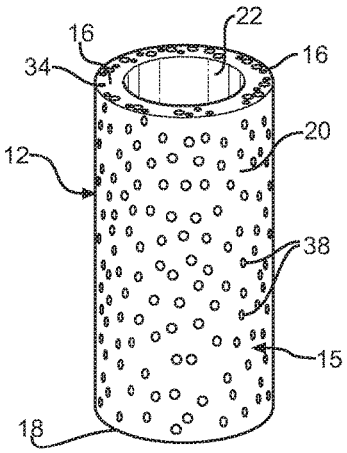
FIG. 6A is a perspective view of a first embodiment of a hub suitable for use in a compressor wheel as disclosed herein.
Figure 6B:
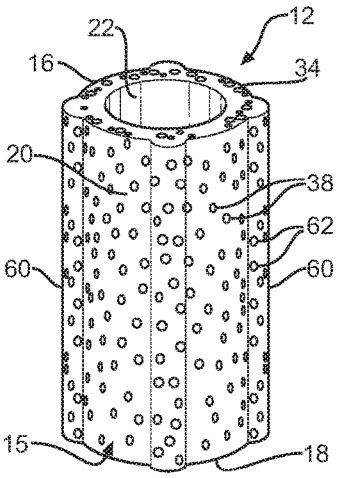
FIG. 6B is a perspective view of a second embodiment of a hub as disclosed herein.

As illustrated in FIGS. 6A and 6B, the hub 12 has an outlet end 16 and an inlet end 18, an arcuate outer surface 20 and a shaft bore 22 and is configured for permanent or detachable engagement with a rotatable shaft. One such rotatable shaft is turbine shaft 110 that can be associated with a suitable turbocharger such as the turbocharger depicted in FIG. 5. Rotatable shaft such as turbine shaft 110 can be received into shaft bore 22 defined in the hub 12 from the inlet end 18 and can extend through the shaft bore 22 to the outlet end 16 or to a suitable location short of the outlet end 16. It is also contemplated that, in certain configurations, the rotatable shaft can extend or project beyond the outlet end 16 if desired or required. The rotatable shaft such as turbine shaft 110 can be connected to hub 12 by any suitable manner.

The centrifugal compressor wheel 10 as disclosed herein also includes a blade array 24 that is connected to the arcuate outer surface 20 of the axially extending hub 12 and extends outward therefrom. The blade array 24 includes a plurality of circumferentially-spaced, radially and axially extending, arcuate centrifugally disposed impeller blades 26. Any suitable number of impeller blades 26 may be utilized in blade array 24 depending on the design requirements of centrifugal compressor wheel 10. Impeller blades 26 may have any suitable circumferential spacing(s). Similarly, impeller blades 26 may extend radially and axially to any desired extent and have any suitable shape, particularly of the blade surfaces 27. The impeller blades 26 comprise airfoils, and the blade surfaces 27 may comprise airfoil surfaces. In certain embodiments, the shape of the impeller blades 26 may be described by a plurality of connected chords that project outwardly from the arcuate outer surface 20 of the axially extending hub 12 in a chordal direction 25. As used herein, a chord or chordal direction 25 is used to refer to a line segment joining two points of a curve and comprises the width of the impeller blades 26, or in the context of the impeller blades 26 as airfoils, a straight-line segment connecting the leading and trailing edges of an airfoil section. A direction generally transverse to chordal direction 25 may be defined as transchordal direction 29 and generally extends along the length of the impeller blades 26. In certain embodiments, the specific contouring of various impeller blades 26 may include a forward blade rake 56 generally adjacent to the outlet end 16 for at least some of the impeller blades 26, as illustrated in FIG. 1 and at least some backward curvature 58 near the periphery of the impeller blades 26, if desired or required.

The blade array 24 of the centrifugal compressor wheel 10 has an outer region 23 and an inner region 21. The blade array 24 of the centrifugal compressor wheel 10 can be formed of a suitable polymeric material 30. The polymeric material employed in the blade array 24 can be a thermoplastic or thermoset polymeric material suitable for use at elevated temperature and extended duty cycle. Non-limiting examples of such materials include epoxy compounds, phenolic polymers, polyimide polymers, polyamide polymers, polypropylene polymers or polyalkylarylketone polymers including but not limited to polyether ether ketone polymer.

Non-limiting examples of suitable epoxy resin compounds include those cross-linked with themselves as well as polyepoxides reacted with various polyfunctional hardeners to form thermosetting polymers. Suitable materials are formulated from epoxy resin prepolymers or higher molecular weight polymers that contain two or more epoxide groups. Non-limiting examples of suitable epoxy resins include bisphenol A which when reacted with epichlorhydrin yields diglycidyl ethers having the general formula:

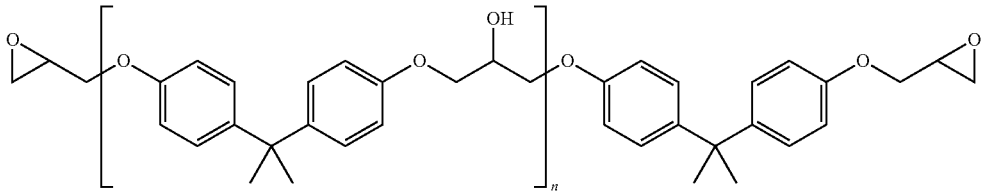

in which n is an integer between 0 and 25. Other epoxy resins that can be employed include materials such as bisphenol F epoxy resin which undergoes epoxidation in a manner similar to bisphenol A as well as epoxy resins such as novolac epoxy resin, aliphatic epoxy resins formed by processes such as the glycidylaton of alipahtic alcohols or polyols to form monofunctional (e.g. dodecanol glycidyl ether), difunctional (butanediol diglycidyl ether), or higher functionality (e.g. trimethylolpropane triglycidyl ether) resins. Still other epoxy resins may include Glycidylamine epoxy resins such as those formed by the reaction of aromatic amines with epichlorhydrin; non-limiting examples of which include -p-aminophenol (functionality 3) and N, N', N", N'"-tetraglycidyl-bis-(4-aminophenyl)-methan (functionality 4).

The epoxy resin material can be cured by homopolymerization or by copolymerization with suitable polyfunctional curatives or hardeners including but not limited to include amines, acids, acid anhydrides, phenols, alcohols and thiols. Hardeners can be ambient or latent hardeners as desired or required.

Phenolic polymers as the term is used herein is defined as polymers based on various reaction products of phenols or substituted phenols with formaldehyde. Such material can be homopolymerized or can be polymerized with suitable copolymerizabel components and can be present as novolac resins or resol resins.

Polyimides suitable for use in the blade array 24 of the compressor wheel as disclosed herein can include materials produced by various methods such as reaction between a suitable dianhydride and a diamine or by reaction of a suitable dianhydride with a diisocyanate and can have the general formula:

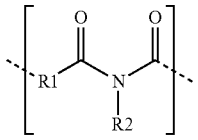

In which R1 can be an aliphatic group, an aromatic group or a mixture of the two. In certain embodiments, non-limiting examples of suitable materials include materials such as poly-oxydiphenylene-pyromellitimide, commercially available under the trade designation "KAPTON" and believed to have the formula:

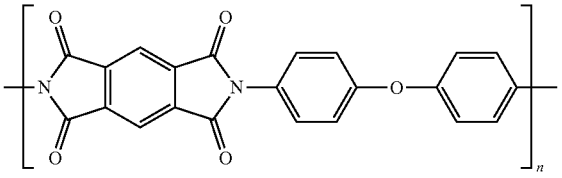

Suitable polyamide materials include aromatic, semi aromatic and aliphatic materials that are homopolymerized or copolymerized with suitable materials to provide or enhance desired properties, including temperature resistance and durability. Non-limiting examples of suitable aliphatic polyamides include Nylon 12, Nylon 11, Nylon 6, Nylon 6,6 and the like. Non-limiting examples of suitable semi-aromatic polyamides include polyphthalamides such as those having the general formula:

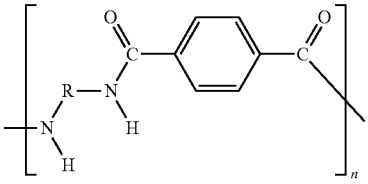

and is defined as such when 55% or more moles of the carboxylic acid portion of the repeating unit in the polymer chain is composed of a combination of terephthalic (TPA) and isophthalic (IPA) acids. Non-limiting examples of suitable polymers include PA 6T/66, PA 6T/DT and PA 6T/6I. It is also contemplated that the semi-aromatic polyamides can be blended or copolymerized with other polymeric materials.

Suitable polyether ether ketones have the general formula:

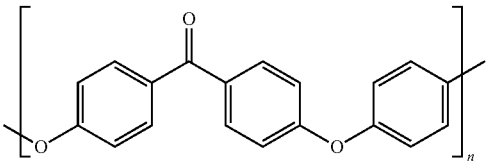

and can have an operating temperature above the operating temperature of the associated centrifugal compressor wheel 10. In certain applications, the polyether ether ketone of choice will have stability at an operating temperature above about 140° C. with some grades having useful operating temperatures up to or above 250° C.

Where desired or required, the polymeric material 30 may include a filler material 32 such as a plurality of non-woven, discontinuous fibers as a dispersed reinforcing filler material to reinforce the polymer material 30. The polymeric material 30 may include other suitable filler materials as an alternate or in addition to fiber reinforcement. Non-limiting examples of such material can include various organic and inorganic particulate filler materials. In certain embodiments, the filler material 32 may comprise various nanoparticle filler materials, including carbon nanoparticles, such as various types of carbon nanotubes. Polymer matrix composite material 28 may include polymeric material 30 and filler material 32 in any suitable relative amounts while still providing a mixture that may be formed into the desired shape or shapes present in the blade array 24 of centrifugal compressor wheel 10. Filler material 32 may be dispersed in polymeric material 30 in any suitable manner, including as a homogeneous or heterogeneous dispersion.

Filler material 32 may be formed from any suitable particulate and/or non-woven, discontinuous fiber material, including various metal, glass, polymer or carbon particles and/or fibers. Filler material 32 may have any suitable characteristics including length, cross-sectional shape and cross-sectional size (e.g., fiber diameter for a cylindrical fiber), and may include a mixture of materials such as particles and non-woven fibers, of non-woven, discontinuous fibers having different characteristics and/or particles of differing sizes. The fibers that compose filler material 32 may include individual filaments, tows or untwisted bundles of discontinuous chopped) filaments or yarns.

The hub 12 of the centrifugal compressor wheel 10 can be formed of a suitable metal or metal alloy. The metal or metal alloy of choice will be a composition capable of supporting a porous region such as porous region 34. In certain embodiments, the porous region 34 can be located proximate to the arcuate outer surface 20 of hub 12 at a location that is opposed to the inner surface of the shaft bore 22. The hub 12 possesses mechanical strength suitable for operation during use conditions.

The porous region 34 present in the arcuate outer surface 20 of the hub 12 has a configuration that maintains the structural strength and characteristics of the hub 12 for suitable operation during use conditions. In certain embodiments, the porous region 34 can extend over the entire circumferential and longitudinal area defined by the arcuate outer surface 20 of the hub 12. In some embodiments, it is contemplated that the porous region 34 can be discontinuous, if desired or required. Thus, it is considered to be within the purview of this disclosure to provide discrete non-porous regions on the porous arcuate outer surface 20 if desired or required.

In certain embodiments, the porous region 34 can extend uniformly through the cross section of the hub 12 to form the arcuate outer surface 20 to shaft bore 22. In certain embodiments, the porous region 34 can extend from the arcuate outer surface 20 to an interior region that is located between the arcuate outer surface 20 and the inner surface of shaft bore 22 such that the hub 12 is characterized by a solid region that is axially proximate to the inner surface of the shaft bore 22 with the porous region 34 located axially distal to the shaft bore 22. The porous region 34 can have a uniform or substantially uniform pore density in certain embodiments. In other embodiments, it is contemplated that the porous region 34 of hub 12 can include at least one region that exhibits a region of gradient porosity. In certain embodiments, the region of gradient porosity that is intermediate between the region proximate the shaft bore 22 and the arcuate outer surface 20. In certain embodiments, region of gradient porosity varies from greater porosity proximate to the arcuate outer surface 20 of the hub 12 to a less porous region located interior to the arcuate outer surface 20. Greater porosity as the term is employed herein can include pores of greater size, greater numbers of pores per unit area or both.

The porous region 34 defined in the hub 12 can be composed of a plurality of fused particles such as particles 36. Particles 36 can be of any configuration or can be of a plurality of configurations. In the embodiment as depicted in axial cross section FIG. 3A and FIG. 4, the particles 36 are illustrated as spheroids by way of non-limiting example. Other particle geometries are also contemplated as being within the purview of this disclosure. Non-limiting examples of suitable geometries include ovals as well as materials with one or more defined angular surfaces, irregularly shaped particles and the like. It is also contemplated that the porous region 34 defined in the hub 12 can be imparted by a suitable metal foaming process to impart a metal porous region configured as a lattice 37; a non-limiting example of a lattice is shown in axial cross section in FIG. 3B.

The porous region 34 defined in the hub 12 can have pores 38 that have any suitable geometry. In certain embodiments, at least a portion of the pores 38 present in the porous region 34 can be spheroid or reverse spheroid. It is also contemplated that the pores 38 in the porous region 34 can have any suitable geometry that results from the formation process. The pores 38 in the porous regions can also be irregularly shaped. Non-limiting examples of pore geometry includes cylindrical open, cylindrical blind, ink-bottle shaped open, ink bottle shaped blind, funnel shaped open, funnel shaped blind and the like. It is understood that the geometry of the pores 38 can be dependent on the nature of the process by which hub 12 of centrifugal compressor wheel 10 is formed. In certain embodiments, the at least a portion of the pores 38 in the porous region 34 can be positioned in an ordered arrangement if desired or required.

The pores 38 present in the porous region 34 can be close-celled, open-celled or a mixture thereof. In certain embodiments, the porous region 34 can have a plurality of interconnecting pores. The number and size of the pores 38 can be expressed in terms of the total apparent volume of the axially extending hub 12.

In certain embodiments, it is contemplated that the pores 38 located in the porous region 34 define between 0.5 vol. % and 45 vol. % (Vp/V) of the hub 12. In certain embodiments, the pores 38 of the porous region 34 defines between 0.5% and 30% (Vp/V) of hub 12; while in some embodiments, the pores 38 of the porous region 34 constitute between 0.5 vol. % and 10 vol. % (Vp/V) of the hub 12 of the centrifugal compressor wheel 10. In certain embodiments, the hub 12 can comprise material that can be defined as a porous metal. In certain embodiments, the hub 12 can comprise a material that can be defined as a metallic foam. As these terms are used herein, the term "metallic foam" is defined as material having a relatively low bulk density and having a porosity greater than 30% vol. % (pore volume/apparent volume (Vp/V). The term "porous metal" is defined as material having a pore volume less than less than 30 vol % (Vp/V). It is also contemplated that the hub 12 can include regions where the pore volume can be defined as a porous metal in combination with at least one region where the pore volume could be defined as a metallic foam.

The average size of pores 38 present in the porous region 34 can be one that permits inflow and location of a portion of the polymeric material that is employed in the blade array 24 that is proximate to the inner region into at least a portion of pores 38.

In certain embodiments, the average pore size of at least a portion of the pores 38 can be on the same order than the mean free path length of the associated polymeric material in its fluid state in which the fluid material exhibits Knudson diffusion and/or surface diffusion. In certain embodiments, this value can be between about 2 nm and 50 nm. In some embodiments, the average pore size can be greater than the mean free path of the associated polymeric material when the polymeric material is in a fluid state such that the fluid material may exhibit Knudson diffusion and/or capillary diffusion in certain situations. In certain embodiments, the average pore size can be greater than 50 nm.

It is contemplated that portions of the polymeric material that is employed to form the blade array 24 can be in a fluid or a semi-fluid state upon during formation upon contact with the outer region of the hub and can penetrate into the at least a portion of the pores 38 present in the porous region 34 defined in the arcuate outer surface 20 of the hub 12. As the introduced polymeric material solidifies, the polymeric material present in the pores 38 solidifies and is in contiguous contact with associated regions of polymeric material of the blade array 24 present in the surrounding regions such that the polymeric material regions are integrally connected to one another.

Non-limiting examples of suitable metals and metal alloys that can be employed in the hub 12 include aluminum and aluminum alloys, magnesium and magnesium alloys, iron and iron alloys, copper and copper alloys, aluminum and aluminum alloys, titanium and titanium alloys and the like. In certain embodiments, the metal alloy can be a bronze or bronze alloy. In certain embodiments, the hub 12 can comprise at least one of the following: bronze, leaded bronze, copper iron, iron, leaded iron, aluminum, titanium, steel.

Non-limiting examples of bronze material include copper alloyed with suitable alloying metals. In certain embodiments, suitable bronze material composed of copper is alloyed with between 10% and 14% tin. In certain embodiments, the suitable bronze material can also include zinc in addition to or instead of tin. Other bronze materials that can be employed in certain embodiments include but are not limited to phosphor bronze (0.5-11% tin 0.01-0.35% phosphorous, copper balance), aluminum bronze (4-11.5% aluminum, 0.5-6% iron, 0.8%-6% nickel, 0.5-2% manganese, 0.5% zinc, copper balance), and silicon bronze (0-20% zinc, 0.5 to 6% silicon, copper balance).

Suitable stainless steels that can be employed in this disclosure include but are not limited to type 316L. Suitable copper iron alloys can contain copper, iron, and in some instances, beryllium. Non-limiting examples of copper iron alloys include those containing between 65% and 98% copper and between 35% and 2% iron.

Figure 3A:
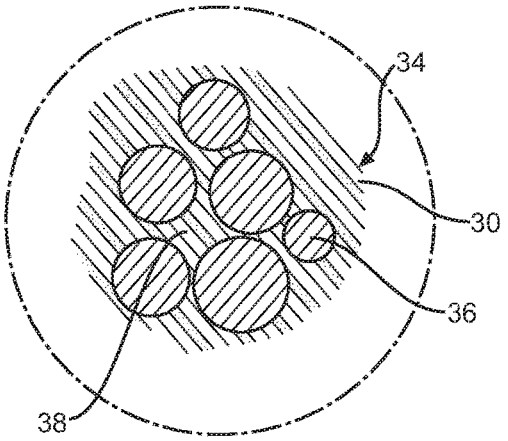
FIGS. 3A and 3B are cross sectional detail views taken at section detail 3 of FIG. 2 in which the metal material of the hub is derived from powdered metal material or derived from metal material in fibrous form, respectively.
Figure 3B:
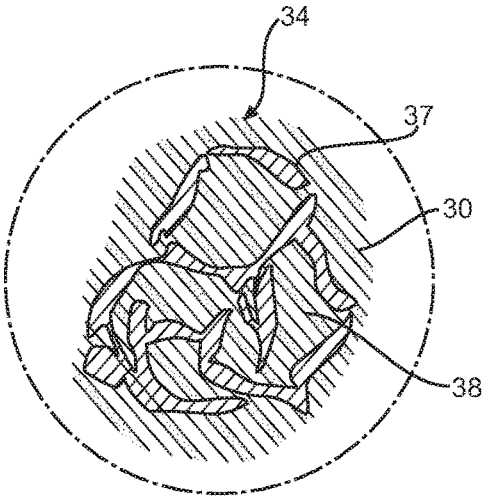
Figure 4:
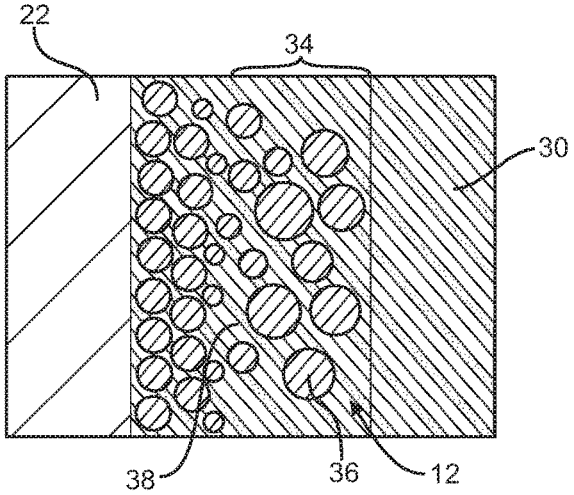
FIG. 4 is a cross sectional detail taken at section detail 4 of FIG. 2 taken through an embodiment of the axially extending hub as disclosed herein.

The hub 12 can be configured to telescopically receive a rotatable shaft such as rotatable shaft 110 therein and a blade array 24 mounted thereon. One non-limiting configuration of hub 12 is depicted in FIG. 3A, wherein the hub 12 can have a body 15 having an inlet end 18 and an opposed outlet end 16. The body 15 can have a generally cylindrical configuration. The hub 12 also has an arcuate outer surface 20 that extends circumferentially around the body 15 and has region(s) of porosity that are located at least proximate to the arcuate outer surface 20. The region(s) of porosity present can extend inward from the arcuate outer surface 20 to an interior region. The region(s) of porosity defined in the arcuate outer surface 20 can be continuous over its surface, if desired or required. The region(s) of porosity as depicted in the various drawing figures can be composed of a plurality of pores 38. The pores 38 can be of a suitable average size and density as described herein. The density of the pores 38 can have a consistent density over the arcuate outer surface. It is also within the purview of this disclosure that the pore density can vary over the arcuate outer surface 20 in a manner consistent with achieving and maintaining bond strength between the polymeric material 30 and the hub 12.

In certain embodiments, the body 15 can include various protrusions and geometric configurations extending outward from the arcuate outer surface 20 to a point distal thereto. The In the embodiment depicted in FIG. 8B, the hub 12 includes at least one ridge 60 that extends from the inlet end 18 to the outlet end 16. The at least one ridge 60 can extend in a spiral or straight orientation relative to the body 15. The at least one ridge 60 can have a height as measured from the arcuate outer surface 20 to the distal end that is contained and encased within the overlaying polymeric material 28 that composes the body portion that makes up the impeller blades 26. The at least one ridge 60 can be configured to provide and enhance adhesion between the polymeric material 28 that composes the impeller blades 26 and the hub 12.

The at least one ridge 60, can have any suitable cross-sectional configuration. Non-limiting examples include rounded U-shaped profiles, squared profiles and the like. The at least one ridge 60 can have a constant profile throughout its length in certain embodiments. In other embodiments, the size and/or shape of the profile of the at least one ridge 60 can vary through its length.

In certain embodiments, such as the embodiment depicted in FIG. 6B, the hub 12 can include at least two ridges 60 that are axially disposed around the outer perimeter of the body 15 of hub 12 and that project outward from the arcuate outer surface 20. It is contemplated that the hub 12 may have more than two axially disposed ridges in some configurations. In the hub 12 illustrated in FIG. 6B, the hub 12 has four ridges 60 that are axially disposed around the periphery of the cylindrical body 15. The at least two ridges 60 are disposed such that rotation of the centrifugal compressor wheel 10 will be balanced during rotational operation.

The at least two ridges 60 can be formed contiguous with the cylindrical body 15 and can be composed of the same material of construction. The at least two ridges 60 can each have an outer surface 62 that is characterized by a plurality of pores 38. The pores 38 present on the one or more ridges 60 can have configurations similar to those described previously in conjunction with the arcuate outer surface 20. It is contemplated that the characteristics of the pores 38 present in the at least two ridges 60 can be similar to those characteristics of pores 38 located on the arcuate outer surface 20 in one or more of pore size, configuration, density, etc. In certain embodiments, one or more of the characteristics of the pores 38 can differ from the pores 38 present in the arcuate outer surface 20 as desired or required.

Figure 7:
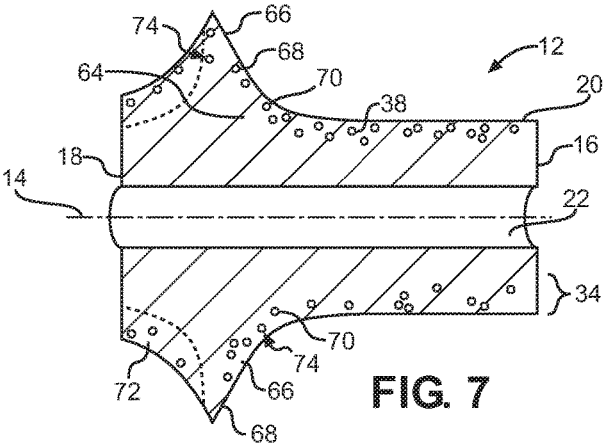
FIG. 7 is a cross-sectional view of a third embodiment of the hub as disclosed herein.

In certain embodiments, the hub 12 can be configured with flairs, projections and the like. Flairs, projections and the like can present on the hub 12 in addition to or instead of the at least two ridges 60. As illustrated in FIG. 7, the hub 12 can include at least two flares 66 located proximate to the inlet end 18 of hub 12. Such flares 66 can project outward from the central body 15 and can project outward therefrom. The flares 66 can be disposed in spaced relation around the circumference of the central body 15 and can be configured in a manner that permits each flare 66 to conform with geometry of an associated impeller blade 26 such that the polymeric material 28 that composes the impeller blade 26 overlies and is bonded to an outer surface 68 of the respective flair 66.

The outer surface 68 of flare 66 is composed of a plurality of pores 70. The pores 70 can extend a distance into the interior body of the flare 66. The pores can have one or more physical characteristics such as pore size, pore density and pore depth sufficient to receive and contain a portion of the polymeric material 28 that composes the overlying impeller blade 26 within the pores 70 such that the polymeric material in the impeller blades is contiguously connected with the polymeric material present in the pores 70.

One non-limiting example of a configuration of the flare 66 is depicted as part of the hub 12 illustrated in FIG. 7. As illustrated in FIG. 7, the hub 12 of the centrifugal compressor wheel 10 includes at least two opposed flares 66 that are symmetrically disposed about the longitudinal axis 14. The hub 12 can include any suitable number of flares 66 that are axially disposed around the arcuate outer surface 20 in a manner that provides balanced rotation about the longitudinal axis 14 when the centrifugal compressor wheel 10 is operatively mounted as in an associated turbocharger.

Each flare 66 can have a configuration suitable to provide support to the associated impeller blade 26 that overlays it. If required, one or more flares 66 can be configured with indentations 72 located at defined regions of the respective flare 66. In certain embodiments, it is contemplated that the number of flares 66 can correspond to the number of blades 26 defined in the blade array 24. It is also considered to be within the purview of this disclosure that the number of flares can be less than the number of blades in certain applications.

The at least two flares 66 can have a body that includes a solid central region 64 with outward located regions that include pores 70 that define an associated porous region 74. The porous region 74 defined in the at least two flares can have pores 70 that have any suitable geometry that can be the same or different from the pores 38.

In certain embodiments, at least a portion of the pores 70 present in the porous region 74 can be spheroid or reverse spheroid. It is also contemplated that the pores 70 in the porous region 74 can have any suitable geometry that results from the formation process. The pores 70 in the porous regions can also be irregularly shaped. Non-limiting examples of pore geometry includes cylindrical open, cylindrical blind, ink-bottle shaped open, ink bottle shaped blind, funnel shaped open, funnel shaped blind and the like. It is understood that the geometry of the pores 70 can be dependent on the nature of the process by which hub 12 of centrifugal compressor wheel 10 is formed. In certain embodiments, the at least a portion of the pores 70 in the porous region 74 can be positioned in an ordered arrangement if desired or required.

The pores 70 present in the porous region 74 can be close-celled, open-celled or a mixture thereof. In certain embodiments, the porous region 74 can have a plurality of interconnecting pores. The number and size of the pores 70 can be expressed in terms of the total apparent volume of the axially extending hub 12 as described previously with regard to pores 38.

The average size of pores 70 present in the porous region 74 can be one that permits inflow and location of a portion of the polymeric material that is employed in the blade array 24 that is proximate to the inner region into at least a portion of pores 70.

In certain embodiments, the average pore size of at least a portion of the pores 70 can be on the same order than the mean free path length of the associated polymeric material in its fluid state in which the fluid material exhibits Knudson diffusion and/or surface diffusion. In certain embodiments, this value can be between about 2 nm and 50 nm. In some embodiments, the average pore size can be greater than the mean free path of the associated polymeric material when the polymeric material is in a fluid state such that the fluid material may exhibit Knudson diffusion and/or capillary diffusion in certain situations. In certain embodiments, the average pore size can be greater than 50 nm.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A compressor wheel (10) comprising:

an axially extending hub (12) having an inlet end (18), a shaft bore (22) extending from the inlet end (18) and an arcuate outer surface (20) opposed to the shaft bore, the axially extending hub comprising a metal, the axially extending hub having at least one porous region, the porous region (34) located proximate to the arcuate outer surface of the axially extending hub;

a blade array (24) disposed on the outer arcuate outer surface of the axially extending hub, the blade array having an outer surface (27) and an inner region (29), the blade array comprising a plurality of circumferentially-spaced, radially and axially extending blades (26) disposed thereon, the blade array comprising at least in part, a polymeric material;

wherein polymeric material that comprises the blade array extends into the porous region defined in the axially extending hub.

2. The compressor wheel of claim 1 wherein the polymeric material of the blade array comprises at least one of epoxy compounds, phenolic polymers, polyimide polymers, polyamide polymers, polypropylene polymers, or polyether ether ketone polymers.

3. The compressor wheel of claim 2 wherein the polymeric material further comprises a reinforcement material, the reinforcement material comprising at least one of metal fibers, glass fibers, carbon fibers, metal particles, glass particles, carbon particles.

4. The compressor wheel of claim 1 wherein axially extending hub further comprises at least two hub-based blade members, the hub based blade members each extending axially outward from the arcuate outer surface of the axially extending hub to a location distal thereto, wherein at least a portion of the plurality of circumferentially-spaced, radially and axially extending blades disposed on the blade array overlie respective hub-based blade members.

5. The compressor wheel of claim 1 wherein the axially extending hub further comprises at least one flinger molded therein.

6. The compressor wheel of claim 1 wherein the axially extending hub further comprises at least one reinforcement region.

7. The compressor wheel of claim 1 wherein the axially extending hub has a cross sectional porosity gradient, wherein porosity proximate to the shaft bore is less than porosity proximate to the outer arcuate surface and wherein the compressor wheel comprises a metal region proximate to the shaft bore of the axially extending hub, a polymeric region proximate to the outer surface of the blade array and an intermediate region, the intermediate region comprising the porous region defined in the arcuate outer surface axially extending hub and characterized by a plurality of pores, the pores having metal side walls and a plurality of polymeric projections extending contiguously from the polymeric region into the plurality of pores, wherein the polymeric material in the projections contacts at least a portion of the metal side walls of the pores.

8. The compressor wheel of claim 7 wherein the at least a portion of the plurality of pores have irregular configurations.

9. The compressor wheel of claim 7 wherein the porous region of the arcuate outer surface of the axially extending hub is composed of a plurality of porous layers in overlying relationship to one another and where in the polymeric material of the blade array extends into at least two layers.

10. The compressor wheel of claim 7 wherein the polymeric material of the blade array comprises at least one of epoxy resin, phenolic polymers, polyimide polymers, polyamide polymers, polypropylene polymers, polyether ether ketone polymers.

11. The compressor wheel of claim 1 wherein the metal of the axially extending hub comprises at least one of bronze, leaded bronze, copper iron, iron, leaded iron, aluminum, titanium, steel.

12. A compressor wheel comprising:

an axially extending hub defining a hub volume and having an inlet end, an outlet end and arcuate outer surface and a shaft bore, the axially extending hub comprising a metal, the hub having at least one porous region, the porous region located proximate to the outer surface, the porous region having a plurality of pores extending from the arcuate outer surface to a region interior thereto, wherein the pores in the porous region define between 0.5% and 45% of the hub volume;

a blade array disposed on the outer arcuate outer surface of the axially extending hub, the blade array having an outer surface and an inner surface, the blade array comprising a plurality of circumferentially-spaced, radially and axially extending blades disposed thereon, the blade array comprising at least in part, a thermosetting polymeric material;

wherein polymeric material that comprises the blade array extends into the porous region defined in the axially extending hub.

13. The compressor wheel of claim 12 wherein the pores of the porous region define between 0.5% and 10% of the hub volume.

14. The compressor wheel of claim 12 wherein the pores of the porous region has a structure that is at least partially open-celled.

15. The compressor wheel of claim 14 wherein at least a portion of the pores are interconnected.

16. The compressor wheel of claim 12 wherein the metal of the axially extending hub comprises at least one of bronze, leaded bronze, copper iron, iron, leaded iron, aluminum, titanium, steel.

17. The compressor wheel of claim 16 wherein the thermosetting polymeric material of the blade array comprises at least one of epoxy resin, phenolic resin, polyimide resin, polyamide resin, polypropylene resin, or polyether ether ketone resin.

18. The compressor wheel of claim 17 wherein the axially extending hub has a cross sectional porosity gradient, wherein porosity proximate to the shaft bore is less than porosity proximate to the outer arcuate surface and wherein the compressor wheel comprises a metal region proximate to the shaft bore of the axially extending hub, a polymeric region proximate to the outer surface of the blade array and an intermediate region, the intermediate region comprising the porous region defined in the arcuate outer surface axially extending hub and characterized by a plurality of pores, the pores having metal side walls and a plurality of polymeric projections extending contiguously from the polymeric region into the plurality of pores, wherein the polymeric material in the projections contacts at least a portion of the metal side walls of the pores.

19. A turbocharger comprising the compressor wheel of claim 1 operatively mounted therein.

20. The turbocharger of claim 19 wherein the polymeric material of the blade array is a thermosetting polymer comprising at least one of epoxy resin, phenolic resin, polyimide resin, polyamide resin, polypropylene resin, or polyether ether ketone resin and the metal of the axially extending hub comprises at least one of bronze, leaded bronze, copper iron, iron, leaded iron, aluminum, titanium, steel, and wherein the axially extending hub has a hub volume and the pores in the porous region define between 0.5% and 45% of the hub volume and are interconnected with one another.

* * * * *